US010593141B2

(12) United States Patent
Nagashima

(10) Patent No.: US 10,593,141 B2
(45) Date of Patent: Mar. 17, 2020

(54) COIN DETECTION ANTENNA AND COIN PROCESSING DEVICE

(71) Applicant: FUJI ELECTRIC CO., LTD., Kawasaki-shi, Kanagawa (JP)

(72) Inventor: Ryuuichi Nagashima, Yokkaichi (JP)

(73) Assignee: FUJI ELECTRIC CO., LTD., Kawasaki-Shi, Kanagawa (JP)

( * ) Notice: Subject to any disclaimer, the term of this patent is extended or adjusted under 35 U.S.C. 154(b) by 24 days.

(21) Appl. No.: 16/139,851

(22) Filed: Sep. 24, 2018

(65) Prior Publication Data

US 2019/0164371 A1 May 30, 2019

(30) Foreign Application Priority Data

Nov. 27, 2017 (JP) ..... 2017-226576

(51) Int. Cl.

| | |
|---|---|
| ***G07D 5/02*** | (2006.01) |
| ***G07D 3/14*** | (2006.01) |
| ***H01Q 9/27*** | (2006.01) |
| ***G07D 5/10*** | (2006.01) |
| ***H01F 21/00*** | (2006.01) |
| ***H01F 5/00*** | (2006.01) |
| ***G07D 5/08*** | (2006.01) |
| *G07D 9/02* | (2006.01) |

(52) U.S. Cl.

CPC ..... *G07D 5/02* (2013.01); *G07D 3/14* (2013.01); *G07D 5/08* (2013.01); *G07D 5/10* (2013.01); *H01F 5/003* (2013.01); *H01F 21/005* (2013.01); *H01Q 9/27* (2013.01); *G07D 9/02* (2013.01)

(58) Field of Classification Search

CPC .. G07D 5/02; G07D 5/08; G07D 5/10; G07D 3/14; H01Q 9/27; H01F 5/003; H01F 21/005

See application file for complete search history.

(56) References Cited

U.S. PATENT DOCUMENTS 4,353,453 A * 10/1982 Partin ..... G07D 5/08 194/319

FOREIGN PATENT DOCUMENTS

JP 2017-058861 A 9/2015

* cited by examiner

*Primary Examiner* — Mark J Beauchaine
(74) *Attorney, Agent, or Firm* — Manabu Kanesaka

(57) ABSTRACT

A coin detection antenna includes a substrate and an air core coil in a track shape including a wiring pattern provided on the substrate, and a width of an air core of the air core coil in a short-side direction is equal to or less than twice a thickness of a smallest coin having a smallest thickness of coins to be detected.

8 Claims, 3 Drawing Sheets

COIN DETECTION ANTENNA AND COIN PROCESSING DEVICE

CROSS-REFERENCE TO RELATED APPLICATION

The present application claims a priority of Japanese Patent Application number JP2017-226576, Coin Detection Antenna and Coin Processing Device, filed Nov. 27, 2017, and is hereby incorporated by reference.

BACKGROUND OF THE INVENTION

Field of the Invention

The present invention relates to a coin detection antenna and a coin processing device, and more particularly, it relates to a coin detection antenna and a coin processing device each including an air core coil.

Description of the Background Art

A coin processing device including an air core coil is known in general, as disclosed in Japanese Patent Laid-Open No. 2017-058861, for example.

Japanese Patent Laid-Open No. 2017-058861 discloses a coin change machine (coin processing device) that performs input and output of coins. The coin change machine includes a coin slot through which coins are inserted, and a tray to which coins are discharged. A sensor element that detects whether or not coins remain in the tray is disposed at a lower portion of the tray. The sensor element includes a substrate and a spiral coil (air core coil) provided on a surface of the substrate. The spiral coil is a coil including a spiral wiring pattern, and includes an air core as a space where a coil is not wound on the innermost side of the spiral.

In the air core coil as disclosed in Japanese Patent Laid-Open No. 2017-058861, when an upright coin is located at a location corresponding to the air core of the air core coil, there are cases where the upright coin cannot be detected because a magnetic field cannot be sufficiently blocked by the coin.

SUMMARY OF THE INVENTION

The present invention has been proposed in order to solve the aforementioned problem, and an object of the present invention is to provide a coin detection antenna and a coin processing device each capable of detecting an upright coin even when the upright coin is located at a location corresponding to an air core of an air core coil.

In order to attain the aforementioned object, a coin detection antenna according to a first aspect of the present invention includes a substrate and an air core coil of track shape including a wiring pattern provided on the substrate, and a width of an air core of the air core coil in a short-side direction is equal to or less than twice a thickness of a smallest coin having a smallest thickness of coins to be detected.

In the coin detection antenna according to the first aspect of the present invention, as described above, the width of the air core of the air core coil in the short-side direction is equal to or less than twice the thickness of the smallest coin having the smallest thickness of the coins to be detected. Thus, the width of the air core of the air core coil in the short-side direction can be made sufficiently small with respect to the thickness of the smallest coin, and thus an upright coin can reliably block a magnetic field even when the upright coin is located at a location corresponding to the air core of the air core coil. Consequently, even when the upright coin is located at the location corresponding to the air core of the air core coil, the upright coin can be detected.

In the aforementioned coin detection antenna according to the first aspect, the width of the air core of the air core coil in the short-side direction is preferably equal to or less than 1.5 times the thickness of the smallest coin. According to this structure, even when the upright coin is located at the location corresponding to the air core of the air core coil, the magnetic field can be more reliably blocked by the upright coin, and thus the upright coin can be more reliably detected.

In the aforementioned coin detection antenna according to the first aspect, a length of a linear portion of the air core coil in a direction in which the linear portion extends is preferably equal to or more than a diameter of the smallest coin having a smallest diameter of the coins to be detected. According to this structure, as compared with the case where the length of the linear portion of the air core coil in the direction in which the linear portion extends is less than the diameter of the smallest coin, the magnetic field can be more reliably blocked by the coins, and thus the coins can be more reliably detected.

In the aforementioned coin detection antenna according to the first aspect, the air core coil preferably includes a plurality of air core coils, and the plurality of air core coils is preferably disposed along short-side directions of air cores of the plurality of air core coils such that the air core coils in which current flow directions in adjacent portions are same as each other are adjacent to each other. Here, when the upright coin is located at a location corresponding to a gap between the adjacent air core coils, there are cases where the upright coin cannot be detected because the magnetic field cannot be sufficiently blocked by the coin, similarly to the case where the upright coin is located at a location corresponding to the air core of each of the air core coils. Therefore, as described above, the plurality of air core coils is disposed along the short-side direction of the air core such that the air core coils in which the current flow directions in the adjacent portions are the same as each other are adjacent to each other. Thus, the magnetic field can be generated to connect the air cores of the adjacent air core coils. Consequently, even when the upright coin is located at the location corresponding to the gap between the adjacent air core coils, the upright coin can reliably block the magnetic field generated to connect the air cores of the adjacent air core coils. Thus, even when the upright coin is located at the location corresponding to the gap between the adjacent air core coils, the upright coin can be detected. Furthermore, the air core coil includes the plurality of air core coils such that the coins can be detected in a wide range, and thus both the upright coin and the coin laid flat can be easily detected. In order to detect the coins in a wide range, it is only necessary to provide one substrate on which the plurality of air core coils is provided, and it is not necessary to provide a plurality of substrates on which the air core coils are provided, and thus the structural complexity of the coin detection antenna can be significantly reduced or prevented. Furthermore, the plurality of air core coils is disposed along the short-side direction of the air core such that generation of a dead space can be prevented as little as possible, and thus the size of the substrate can be reduced. Consequently, even when the plurality of air core coils is provided, the size of the coin detection antenna can be reduced.

In the aforementioned structure in which the air core coils in which the current flow directions in the adjacent portions are the same as each other are adjacent to each other, a size of a gap between the air core coils adjacent to each other preferably allows generation of a magnetic field that connects air cores of the air core coils adjacent to each other. According to this structure, even when the upright coin is located at the location corresponding to the gap between the adjacent air core coils, the upright coin can be more reliably detected.

In this case, the size of the gap between the air core coils adjacent to each other is preferably equal to or less than a width of each of the air cores of the plurality of air core coils in the short-side directions. According to this structure, the magnetic field that connects the air cores of the adjacent air core coils can be more reliably generated.

In the aforementioned structure in which the air core coils in which the current flow directions in the adjacent portions are the same as each other are adjacent to each other, the plurality of air core coils is preferably connected in series. According to this structure, the air core coils can be connected to each other with a simple structure as compared with the case where the plurality of air core coils is connected in parallel.

A coin processing device according to a second aspect of the present invention includes a coin retaining unit and a coin detection antenna provided at a location corresponding to the coin retaining unit, the coin detection antenna includes a substrate and an air core coil of track shape including a wiring pattern provided on the substrate, and a width of an air core of the air core coil in a short-side direction is equal to or less than twice a thickness of a smallest coin having a smallest thickness of coins to be detected.

In the coin processing device according to the second aspect of the present invention, as described above, the width of the air core of the air core coil in the short-side direction is equal to or less than twice the thickness of the smallest coin having the smallest thickness of the coins to be detected. Thus, similarly to the aforementioned coin detection antenna according to the first aspect, an upright coin can be detected even when an upright coin is located at a location corresponding to the air core of the air core coil.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention are hereinafter described with reference to the drawings.

First Embodiment

The structure of a coin processing device (change machine) 100 according to a first embodiment is now described with reference to FIGS. 1 to 3.

Structure of Coin Processing Device

Figure 1:
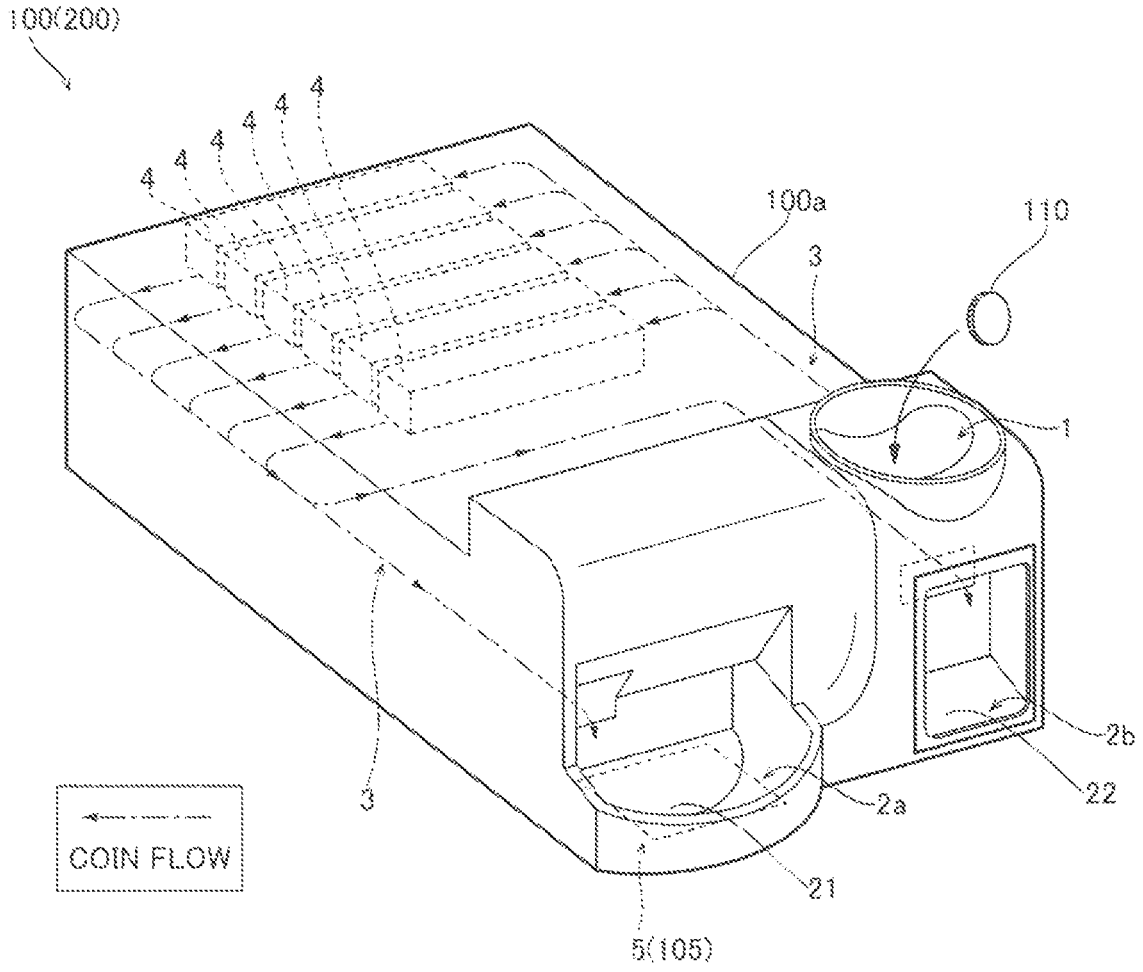
FIG. 1 is a perspective view showing a coin processing device according to first and second embodiments.

As shown in FIG. 1, the coin processing device 100 is a device that performs input and output of coins 110. The coin processing device 100 constitutes a part of a POS system including a POS (point of sales) register, a bill processing device, a coin roll container, etc., for example. The coin processing device 100 is installed in a store such as a supermarket or a convenience store, for example.

The coin processing device 100 includes an insertion slot 1, two discharge ports 2*a* and 2*b*, a coin transfer unit 3, and coin containers 4. The insertion slot 1 is an entrance through which the coins 110 are inserted from the outside to the inside of a housing 100*a* of the coin processing device 100. The insertion slot 1 communicates with the inside of the housing 100*a* of the coin processing device 100. The discharge ports 2*a* and 2*b* are exits through which the coins 110 are discharged from the inside to the outside of the housing 100*a* of the coin processing device 100. The discharge port 2*a* is a discharge port through which the coins 110 for change are discharged. The discharge port 2*b* is a discharge port through which the return coins 110 are discharged. The discharge ports 2*a* and 2*b* communicate with the inside of the housing 100*a* of the coin processing device 100. The discharge port 2*a* includes a tray 21 as a coin retaining unit. The tray 21 receives and stores the discharged coins 110. The tray 21 is an example of a "coin retaining unit" in the claims. The coin retaining unit may be a coin retaining unit other than the tray 21 as long as the same is a portion of the coin processing device 100 in which the coins 110 are retained and that requires detection of the coins 110. For example, the coin retaining unit may be a predetermined portion of a transfer path of the coin transfer unit 3. Furthermore, the coin retaining unit may be a coin receiving unit 22 of the discharge port 2*b* of the return coins 110. FIG. 1 shows an example in which a coin detection antenna 5 described below is provided at a location corresponding to the tray 21 of the discharge port 2*a*.

The coin transfer unit 3 transfers the coins 110 inside the housing 100*a* of the coin processing device 100. The coin transfer unit 3 includes a belt mechanism that transfers the coins 110, for example. The coin transfer unit 3 transfers the coins 110 inserted through the insertion slot 1 toward the coin containers 4. The coins 110 transferred toward the coin containers 4 are contained in the coin containers 4 corresponding to denominations in a state where the coins 110 are sorted by a sorting unit (not shown) that sorts the coins 110 per denomination. Furthermore, the coin transfer unit 3 transfers the coins 110 contained in the coin containers 4 toward the discharge port 2*a* or 2*b*. The coin transfer unit 3 transfers the coins 110 (coins 110 for change) for the amount obtained by subtracting a product price from the input money amount toward the discharge port 2*a*, for example.

The coin containers 4 contain the coins 110. The coin containers 4 are provided for each denomination. The coin containers 4 include a coin container that contains 1-yen coins, a coin container that contains 50-yen coins, a coin container that contains 5-yen coins, a coin container that contains 100-yen coins, a coin container that contains 10-yen coins, and a coin container that contains 500-yen coins, for example. The denominations of the coins 110 to be processed by the coin processing device 100 are not restricted to the Japanese denominations, but may be the denominations of any country.

The coin processing device 100 includes the coin detection antenna 5 that detects whether or not the coins 110 (see FIG. 3) remain in the coin retaining unit (the presence or absence of the coins 110). The coin detection antenna 5 is provided at a location in the coin processing device 100 (a location that overlaps the coin retaining unit) corresponding to the coin retaining unit (such as the tray 21) in which the coins are retained.

Figure 2:
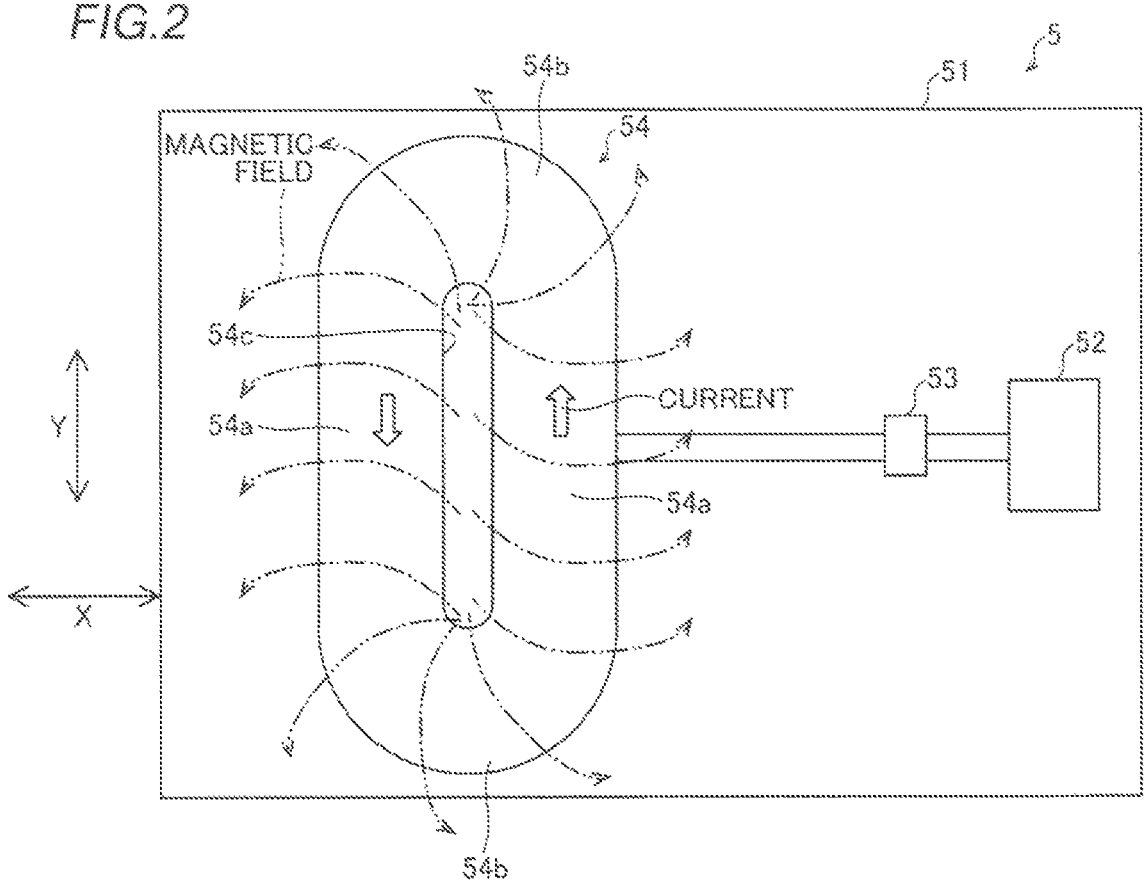
FIG. 2 is a diagram showing a coin detection antenna according to the first embodiment.

As shown in FIG. 2, the coin detection antenna 5 includes a substrate 51, a connector 52, a capacitor 53, and an air core coil 54. The substrate 51 is a circuit board made of resin, on which a wiring pattern is provided. The connector 52, the capacitor 53, and the air core coil 54 are provided on the substrate 51. The connector 52 is connected to an AC power source (not shown). The connector 52 supplies AC power from the AC power source to the capacitor 53 and the air core coil 54. The capacitor 53 is a resonance capacitor. The capacitor 53 and the air core coil 54 constitute a resonance circuit.

The air core coil 54 includes a spiral wiring pattern provided on the substrate 51. The air core coil 54 is energized to generate a magnetic field. The magnetic field is circularly generated around the wiring pattern of the air core coil 54. The magnetic field is oriented in a direction substantially perpendicular to the air core coil 54 in the vicinity of an air core 54*c* of the air core coil 54 described below. The magnetic field is oriented in a direction substantially parallel to the air core coil 54 in the vicinity of linear portions 54*a* and arcuate portions 54*b* of the air core coil 54 described below. In FIG. 2, current that flows through the air core coil 54 and the magnetic field (indicated by a two-dot chain line) generated by the air core coil 54 are indicated by arrows.

Whether or not the coins 110 remain in the coin retaining unit is detected based on the fact that the generated magnetic field is blocked by the coins 110. Specifically, whether or not the coins 110 remain in the coin retaining unit is detected based on a change of the resonance frequency from the reference frequency due to the magnetic field blocked by the coins 110.

The air core coil 54 is a coil of track shape (rounded rectangular shape) having a short-side direction in a direction X and a longitudinal direction in a direction Y. The air core coil 54 includes the linear portions 54*a*, the arcuate portions 54*b*, and the air core 54*c*. The linear portions 54*a* are linearly formed portions of the air core coil 54. A pair of linear portions 54*a* faces each other in the direction X (the short-side direction of the air core 54*c*) with the air core 54*c* interposed therebetween. The arcuate portions 54*b* are arcuately formed portions of the air core coil 54. A pair of arcuate portions 54*b* faces each other in the direction Y (the longitudinal direction of the air core 54*c*) with the air core 54*c* interposed therebetween. On one side and the other side in the direction Y, the pair of arcuate portions 54*b* connects the pair of linear portions 54*a* disposed at a distance in the direction X. The air core 54*c* is a portion of the air core coil 54 defined by the inner edges of the linear portions 54*a* and the arcuate portions 54*b*. The air core 54*c* has an elongated hole shape (elongated oval shape). Both sides of the air core 54*c* in the direction X are linear, and both ends of the air core 54*c* in the direction Y are arcuate. The air core 54*c* is provided on the innermost side of the air core coil 54. The air core 54*c* is provided substantially at the center position of the air core coil 54.

Figure 3:
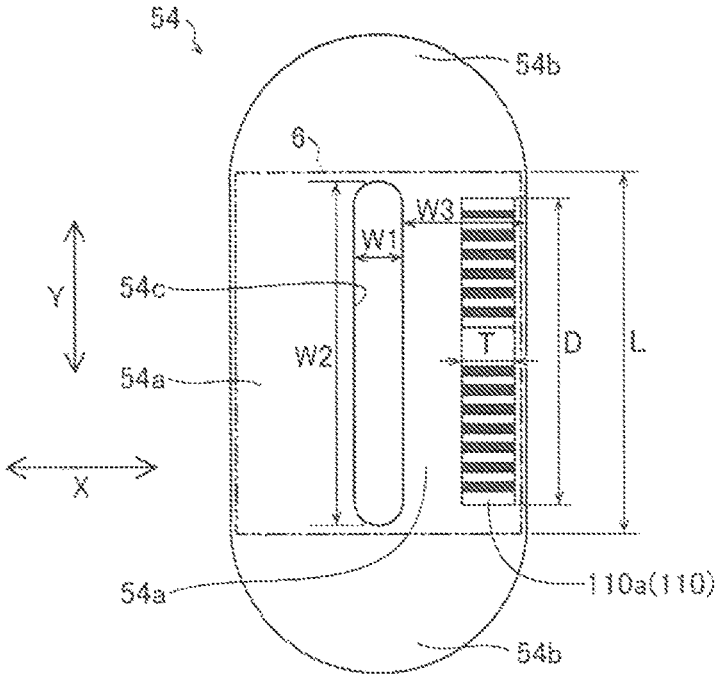
FIG. 3 is a diagram showing an air core coil of the coin detection antenna according to the first embodiment and the smallest coin.

According to the first embodiment, as shown in FIG. 3, the width W1 of the air core 54*c* in the short-side direction (direction X) is equal to or less than twice the thickness T of the smallest coin 110*a* of the coins 110 to be detected. In this case, in a state where the smallest coin 110*a* is located at a location corresponding to the center position of the air core 54*c* in the short-side direction, the air core 54*c* overlaps the smallest coin 110*a* by one-half or more in the short-side direction. Preferably, the width W1 is equal to or less than 1.5 times the thickness T of the smallest coin 110*a*. In this case, in a state where the smallest coin 110*a* is located at the location corresponding to the center position of the air core 54*c* in the short-side direction, the air core 54*c* overlaps the smallest coin 110*a* by two thirds or more in the short-side direction. More preferably, the width W1 is equal to or less than the thickness T of the smallest coin 110*a*. In this case, in a state where the smallest coin 110*a* is located at the location corresponding to the center position of the air core 54*c* in the short-side direction, the air core 54*c* entirely overlaps the smallest coin 110*a* in the short-side direction.

In FIG. 3, the smallest coin 110*a* upright in the coin retaining unit is shown as a coin 110. The smallest coin 110*a* is a coin having the smallest thickness and the smallest diameter of the coins 110 to be detected. Here, the "upright coin" denotes a coin substantially perpendicular to the air core coil 54. In addition, the coin detection antenna 5 can detect not only the coins 110 upright in the coin retaining unit but also the coins 110 laid flat in the coin retaining unit. Here, the "coin laid flat" denotes a coin substantially parallel to the air core coil 54.

The width W2 of the air core 54*c* in the longitudinal direction (direction Y) and the length L of each of the linear portions 54*a* in a direction (direction Y) in which the linear portions 54*a* extend are equal to or more than the diameter D of the smallest coin 110*a*. Furthermore, the width W3 of each of the linear portions 54*a* in the direction X is equal to or more than the width W1 of the air core 54*c* in the short-side direction (direction X) and are equal to or more than the thickness T of the smallest coin 110*a*.

The air core coil 54 is disposed such that a detection range 6 is within the wiring pattern. Specifically, the air core coil 54 is disposed such that substantially the entirety of the pair of linear portions 54*a* and substantially the entirety of the air core 54*c* are within the detection range 6. The air core coil 54 is disposed such that a portion substantially excluding the pair of arcuate portions 54*b* is within the detection range 6. The detection range 6 is a predetermined range for detecting the coins 110. The detection range 6 is a range in which the smallest coin 110*a* can move in the coin retaining unit, for example.

Advantageous Effects of First Embodiment

According to the first embodiment, the following advantageous effects are achieved.

According to the first embodiment, as described above, the width W1 of the air core 54*c* of the air core coil 54 in the short-side direction is equal to or less than twice the thickness T of the smallest coin 110*a* of the coins 110 to be detected. Thus, even when the upright coin 110 is located at the location corresponding to the air core 54*c* of the air core coil 54, the magnetic field can be reliably blocked by the upright coin 110. Consequently, even when the upright coin 110 is located at the location corresponding to the air core 54*c* of the air core coil 54, the upright coin 110 can be detected.

According to the first embodiment, as described above, the width W1 of the air core 54*c* of the air core coil 54 in the short-side direction is equal to or less than 1.5 times the thickness T of the smallest coin 110*a*. Thus, even when the upright coin 110 is located at the location corresponding to the air core 54*c* of the air core coil 54, the magnetic field can be more reliably blocked by the upright coin 110, and thus the upright coin 110 can be more reliably detected.

According to the first embodiment, as described above, the width W1 of the air core 54*c* of the air core coil 54 in the short-side direction is equal to or less than the thickness T of the smallest coin 110*a*. Thus, even when the upright coin 110 is located at the location corresponding to the air core 54*c* of the air core coil 54, the magnetic field can be still more reliably blocked by the upright coin 110, and thus the upright coin 110 can be still more reliably detected.

According to the first embodiment, as described above, the length L of each of the linear portions 54*a* of the air core coil 54 in the direction in which the linear portions 54*a* extend is equal to or more than the diameter D of the smallest coin 110*a*. Thus, as compared with the case where the length L of each of the linear portions 54*a* of the air core coil 54 in the direction in which the linear portions 54*a* extend is less than the diameter D of the smallest coin 110*a*, the magnetic field can be more reliably blocked by the coins 110, and thus the coins 110 can be more reliably detected.

Second Embodiment

A second embodiment is now described with reference to FIGS. 1, 4, and 5. In this second embodiment, a plurality of air core coils is provided in one coin detection antenna unlike the first embodiment. The same structures as those of the first embodiment are denoted by the same reference numerals, to omit the description.

Structure of Coin Processing Device

Figure 4:
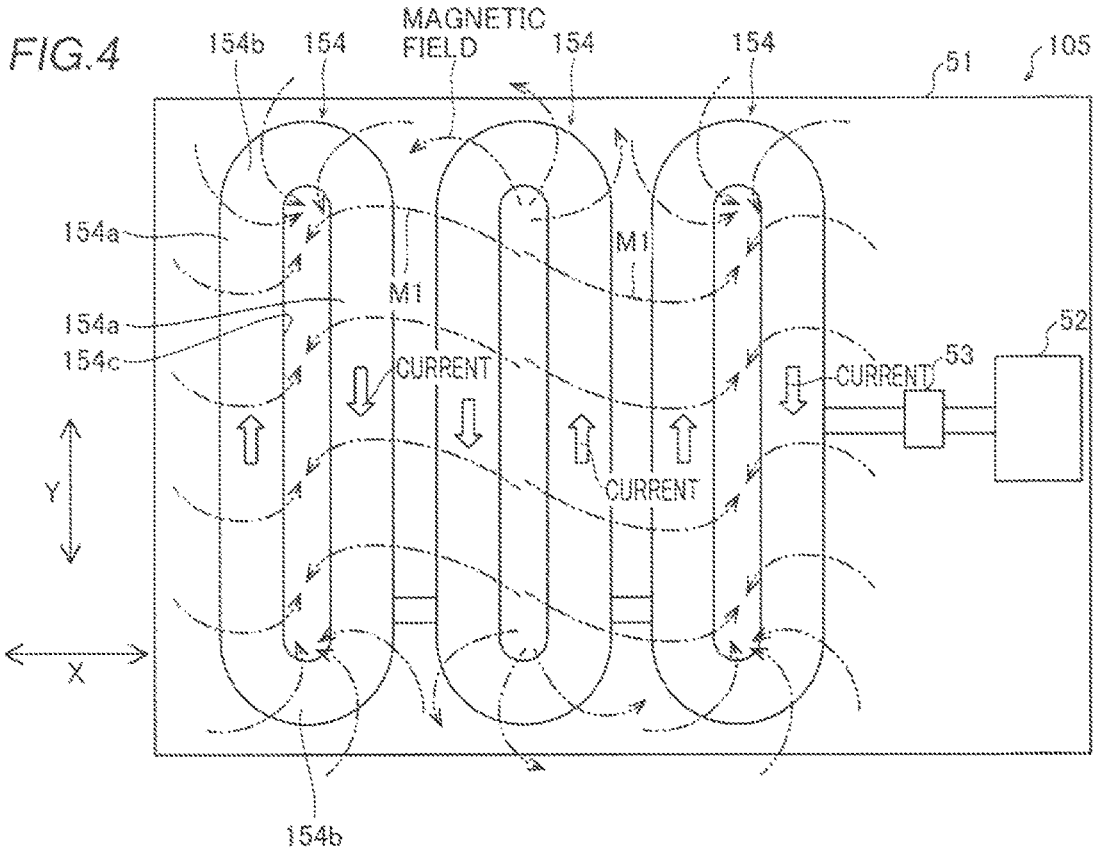
FIG. 4 is a diagram showing a coin detection antenna according to the second embodiment.
Figure 5:
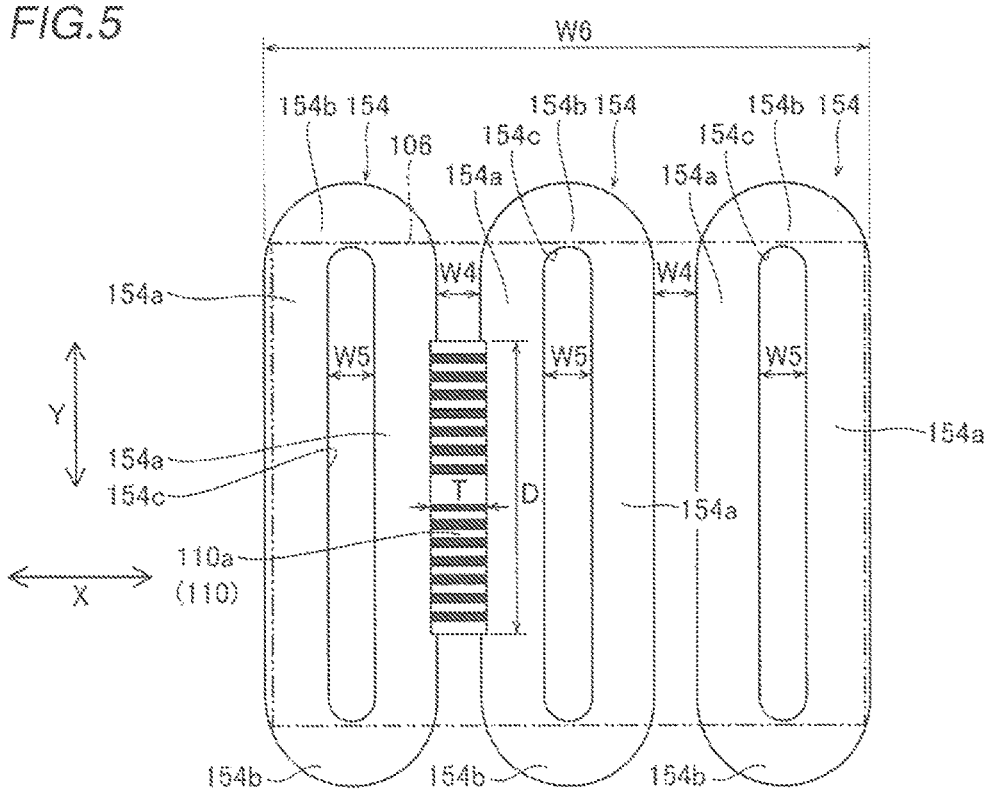
FIG. 5 is a diagram showing an air core coil of the coin detection antenna according to the second embodiment and the smallest coin.

As shown in FIGS. 1 and 4, a coin processing device 200 according to the second embodiment is different from the coin processing device 100 according to the first embodiment in that the coin processing device 200 includes a coin detection antenna 105.

According to the second embodiment, the coin detection antenna 105 includes a plurality of (three) air core coils 154. The plurality of air core coils 154 is provided on one substrate 51. The plurality of air core coils 154 is connected in series.

According to the second embodiment, the plurality of air core coils 154 is disposed along the short-side direction (direction X) of air cores 154*c* such that air core coils 154 in which current flow directions in adjacent portions are the same as each other are adjacent to each other. Thus, in the adjacent portions of the adjacent air core coils 154, current flows in the same direction, and in gaps between the adjacent air core coils 154, magnetic fields are canceled out. Consequently, magnetic fields M1 that connect the air cores 154*c* of the adjacent air core coils 154 are generated. As shown in FIG. 5, the sizes W4 of the gaps between the adjacent air core coils 154 allow generation of magnetic fields that connect the air cores 154*c* of the adjacent air core coils 154. Specifically, the size W4 is equal to or less than the width W5 of each of the air cores 154*c* of the air core coils 154 in the short-side direction. Similarly to the first embodiment, the width W5 is equal to or less than twice the thickness T of the smallest coin 110*a*. A width W6 in the direction X between both ends of the plurality of air core coils 154 is equal to or more than the diameter D of the smallest coin 110*a*. Preferably, the width W6 is equal to or more than twice the diameter D of the smallest coin 110*a*.

The plurality of air core coils 154 is disposed such that a detection range 106 is within a wiring pattern at both ends in the direction X. Specifically, the plurality of air core coils 154 is disposed such that substantially the entirety of each of linear portions 154*a* and substantially the entirety of each of the air cores 154*c* are within the detection range 106. The plurality of air core coils 154 is disposed such that portions substantially excluding arcuate portions 154*b* are within the detection range 106. The plurality of air core coils 154 is substantially equally located in the short-side direction (direction X) of the air cores 154*c* within the detection range 106.

The remaining structures of the second embodiment are similar to those of the first embodiment.

Advantageous Effects of Second Embodiment

According to the second embodiment, the following advantageous effects are achieved.

According to the second embodiment, as described above, the width W5 of each of the air cores 154*c* of the air core coils 154 in the short-side direction is equal to or less than twice the thickness T of the smallest coin 110*a*. Thus, similarly to the first embodiment, even when the upright coins 110 are located at the locations corresponding to the air cores 154*c* of the air core coils 154, the upright coins 110 can be detected.

According to the second embodiment, as described above, the plurality of air core coils 154 is disposed along the short-side direction of the air cores 154*c* such that the air core coils 154 in which the current flow directions in the adjacent portions are the same as each other are adjacent to each other. Here, when the upright coins 110 are located at the locations corresponding to the gaps between the adjacent air core coils 154, there are cases where the upright coins 110 cannot be detected because the magnetic fields cannot be sufficiently blocked by the coins 110, similarly to the case where the upright coins 110 are located at the locations corresponding to the air cores 154*c* of the air core coils 154. Therefore, as described above, the plurality of air core coils 154 is disposed along the short-side direction of the air cores 154*c* such that the air core coils 54 in which the current flow directions in the adjacent portions are the same as each other are adjacent to each other. Thus, the magnetic fields M1 can be generated to connect the air cores 154*c* of the adjacent air core coils 154. Consequently, even when the upright coins 110 are located at the locations corresponding to the gaps between the adjacent air core coils 154, the upright coins 110 can reliably block the magnetic fields M1 generated to connect the air cores 154*c* of the adjacent air core coils 154. Thus, even when the upright coins 110 are located at the locations corresponding to the gaps between the adjacent air core coils 154, the upright coins 110 can be detected. Furthermore, the plurality of air core coils 154 is provided such that the coins 110 can be detected in a wide range, and thus both the upright coins 110 and the coins 110 laid flat can be easily detected. In order to detect the coins 110 in a wide range, it is only necessary to provide one substrate 51 on which the plurality of air core coils 154 is provided, and it is not necessary to provide a plurality of substrates 51 on which the air core coils 154 are provided, and thus the structural complexity of the coin detection antenna 105 can be significantly reduced or prevented. Furthermore, the plurality of air core coils 154 is disposed along the short-side direction of the air cores 154*c* such that generation of a dead space can be prevented as little as possible, and thus the size of the substrate 51 can be reduced.

Consequently, even when the plurality of air core coils 154 is provided, the size of the coin detection antenna 105 can be reduced.

According to the second embodiment, as described above, the sizes W4 of the gaps between the adjacent air core coils 154 allow generation of the magnetic fields M1 that connect the air cores 154*c* of the adjacent air core coils 154. Thus, even when the upright coins 110 are located at the locations corresponding to the gaps between the adjacent air core coils 154, the upright coins 110 can be more reliably detected.

According to the second embodiment, as described above, the size W4 of each of the gaps between the adjacent air core coils 154 is equal to or less than the width W5 of each of the air cores 154*c* of the air core coils 154 in the short-side direction. Thus, the magnetic fields M1 that connect the air cores 154*c* of the adjacent air core coils 154 can be more reliably generated.

According to the second embodiment, as described above, the plurality of air core coils 154 is connected in series. Thus, the air core coils 154 can be connected to each other with a simple structure as compared with the case where the plurality of air core coils 154 is connected in parallel.

The remaining advantageous effects of the second embodiment are similar to those of the first embodiment.

MODIFIED EXAMPLES

The embodiments disclosed this time must be considered as illustrative in all points and not restrictive. The scope of the present invention is not shown by the above description of the embodiments but by the scope of claims for patent, and all modifications (modified examples) within the meaning and scope equivalent to the scope of claims for patent are further included.

For example, while the present invention is applied to the coin processing device as a change machine in each of the aforementioned first and second embodiments, the present invention is not restricted to this. The present invention may alternatively be applied to a coin processing device other than a change machine as long as the coin processing device includes a coin retaining unit and a coin detection antenna.

While the length of each of the linear portions of the air core coil(s) in the direction in which the linear portions extend is equal to or more than the diameter of the smallest coin in each of the aforementioned first and second embodiments, the present invention is not restricted to this. According to the present invention, the length of each of the linear portions of the air core coils in the direction in which the linear portions extend may alternatively be less than the diameter of the smallest coin.

While the size of each of the gaps between the adjacent air core coils is equal to or less than the width of each of the air cores of the air core coils in the short-side direction in the aforementioned second embodiment, the present invention is not restricted to this. According to the present invention, the size of each of the gaps between the adjacent air core coils may alternatively be more than the width of each of the air cores of the air core coils in the short-side direction.

While the plurality of air core coils is connected in series in the aforementioned second embodiment, the present invention is not restricted to this. According to the present invention, the plurality of air core coils may alternatively be connected in parallel.

While the coin detection antenna includes the three air core coils in the aforementioned second embodiment, the present invention is not restricted to this. According to the present invention, the coin detection antenna may alternatively include a plurality of air core coils other than three.

What is claimed is:

1. A coin detection antenna comprising:

a substrate; and an air core coil in a track shape including a wiring pattern provided on the substrate and an air core, wherein a width of the air core of the air core coil in a short-side direction is adapted to be equal to or less than twice a thickness of a smallest coin having a smallest thickness of coins to be detected.

2. The coin detection antenna according to claim 1, wherein the width of the air core of the air core coil in the short-side direction is adapted to be equal to or less than 1.5 times the thickness of the smallest coin.

3. The coin detection antenna according to claim 1, wherein a length of a linear portion of the air core coil in a direction in which the linear portion extends is adapted to be equal to or more than a diameter of the smallest coin having a smallest diameter of the coins to be detected.

4. The coin detection antenna according to claim 1, wherein the air core coil includes a plurality of air core coils, and the plurality of air core coils is disposed along short-side directions of air cores of the plurality of air core coils such that the air core coils in which current flow directions in adjacent portions are same as each other are arranged adjacent to each other.

5. The coin detection antenna according to claim 4, wherein a gap between the air core coils adjacent to each other has a size to generate a magnetic field that connects air cores of the air core coils adjacent to each other.

6. The coin detection antenna according to claim 5, wherein the size of the gap between the air core coils adjacent to each other is equal to or less than a width of each of the air cores of the plurality of air core coils in the short-side directions.

7. The coin detection antenna according to claim 4, wherein the plurality of air core coils is connected in series.

8. A coin processing device comprising:

a coin retaining unit; and a coin detection antenna provided at a location corresponding to the coin retaining unit, wherein the coin detection antenna includes:

a substrate; and an air core coil in a track shape including a wiring pattern provided on the substrate and an air core, and a width of the air core of the air core coil in a short-side direction is adapted to be equal to or less than twice a thickness of a smallest coin having a smallest thickness of coins to be detected.

* * * * *